United States Patent [19]

Watanabe et al.

[11] Patent Number: 4,485,159

[45] Date of Patent: Nov. 27, 1984

[54] LAMINATE TYPE ELECTROPHOTOGRAPHIC LIGHT-SENSITIVE MATERIAL

[75] Inventors: Katsunori Watanabe; Shigeto Ohta; Kiyoshi Sakai; Shozo Ishikawa; Makoto Kitahara, all of Tokyo, Japan

[73] Assignee: Copyer Co., Ltd., Canon Inc., Tokyo, Japan

[21] Appl. No.: 199,878

[22] Filed: Oct. 23, 1980

[30] Foreign Application Priority Data

Oct. 23, 1979 [JP] Japan ..... 54-135890

[51] Int. Cl.[3] ..... G03G 5/14; G03G 5/087

[52] U.S. Cl. ..... 430/58; 430/96

[58] Field of Search ..... 430/58, 59, 96, 900

[56] References Cited

U.S. PATENT DOCUMENTS 3,615,408 10/1971 Taubman ..... 430/69
3,928,034 12/1975 Regensburger ..... 430/58 X
4,082,551 4/1978 Steklenski et al. ..... 430/64
4,088,484 5/1978 Okazaki ..... 430/58 X
4,220,697 9/1980 Wiedmann ..... 430/58 X
4,390,611 6/1983 Ishikawa et al. ..... 430/58

OTHER PUBLICATIONS

Chemical Abstracts vol. 73 Col. 135922e, vol. 68, Col. 17420p.

*Primary Examiner*—John D. Welsh
*Attorney, Agent, or Firm*—Sughrue, Mion, Zinn, Macpeak & Seas

[57] ABSTRACT

In an electrophotographic light-sensitive material comprising at least one electric charge generation layer comprising a charge generating substance and a binder resin therefor and at least one electric charge transport layer on an electrically conductive base, said electrophotographic light-sensitive material is a laminate type electrophotographic light-sensitive material wherein the binder resin for the electric charge generating substance contains at least one polyvinylpyridine resin.

6 Claims, 2 Drawing Figures

LAMINATE TYPE ELECTROPHOTOGRAPHIC LIGHT-SENSITIVE MATERIAL

BACKGROUND OF THE INVENTION

1. Field of the Invention

The present invention relates to an electrophotographic photocunductive composition. In greater detail, it relates to a laminate type electrophotographic light-sensitive material comprising a polyvinylpyridine resin as a binder of a charge generation layer.

2. Development of the Invention

Generally, essential requisites for electrophotographic light-sensitive materials include charge retention capability, high sensitivity, cycle stability, pre-exposure effect resistance (i.e., a property for how fast the surface electric potential of the light-sensitive material when electrically charged after high exposure returns to that when electrically charged before high exposure), dielectric breakdown resistance, friction resistance, solvent resistance, chemical stability (to ozone, etc.), lack of toxicity, storate stability, good developing capability, good transfer capability (i.e., a good toner transfer property from an electrophotographic light-sensitive material to an image-retention material (e.g., paper)), ease of cleaning, spectral sensitivity, low cost, etc.

Recently, laminate type electrophotographic light-sensitive materials have been actively studied in order to provide material satisfying the above requisites, and a number of materials been developed; however, almost all of them have a construction where an electric charge generation layer and an electric charge transport layer are laminated in this order on an electrically conductive base such as aluminum or copper.

The electric charge generation layer of such laminate type electrophotographic light-sensitive materials can be classified into two types. Firstly, vacuum evaporation types obtained by vacuum evaporation of an inorganic substance (such as selenium, seleniumtellurium, cadmium sulfide, etc.) or organic substances comprising dyes or pigments such as various azo pigments, phthalocyanine pigments, polynuclear quinone pigments, indigoid pigments, perylene pigments, quinacridone pigments, pyrylium dyestuffs, thiopyrylium dyestuffs, cyanine dyestuffs, squalidium dyestuffs, triphenylmethane dyestuffs or xanthene dyestuffs. A second class is the pigment dispersion types which are produced by applying a dispersion of fine particles of the above-described inorganic or organic substances in a binder resin such as a polyester resin, acryl resin, polystyrene resin, vinyl acetate resin, vinyl chloride resin, polycarbonate, butyral resin, silicone resin, epoxy resin, melamine resin, urethane resin, etc., or an electric charge generation layer obtained by applying a solution of a dye and the binder resin.

The electric charge transport layer is typically obtained by applying at least one electric charge transport substance selected from electron donating substances such as derivatives of pyrazoline, triphenylmethane, oxadiazole, carbazole, imidazole, oxazole, thiazole, etc., photoconductive polymers such as poly-N-vinylcarbazole, poly-9-vinylphenyl anthracene, etc., with a binder resin, or at least one electron accepting substance such as 2,4,7-trinitro-9-fluorenone, 2,4,5,7-tetranitrofluorenone, 2,4,7-trinitro-9-dicyanomethylenefluorenone, 2,4,5,7-tetranitroxanthrone, etc., with a binder resin, to the electric charge generation layer together with an electrically insulating film forming material such as polyester, polycarbonate, etc. In the above regard, the addition of a small amount of the electron accepting substance to the electron donating substance, or of a small amount of the electron donating substance to the electron accepting substance, may be effected.

Essential requisites for the binder resin used for the electric charge transport layer include high electric insulating and good charging characteristics, high dielectric strength, high friction resistance, no change in charging characteristic by temperature and moisture change, freedom from lowering the electric charge transporting capability of electric charge transport substance, good compatibility with the electric charge transport substance and hard occurrence of crystallizing the electric charge transport substance, and the like. Suitable examples of the binder resin satisfying these requisites include resins conventionally employed, such as polyester resins, polycarbonate resins, acryl resins, etc. Photoconductive polymers which have themselves an electric charge transporting capability, such as poly-N-vinylcarbazole and poly-9-vinylphenyl anthracene can also be employed. These resins can be used alone or in combination with one or more other resins. Specific examples of the binder resins include those disclosed in U.S. Pat. No. 3,850,630 (col. 8, line 67 to col. 9, line 18).

Generally, in electrophotographic light-sensitive materials which are used repeatedly, considering physical strength, the electrically conductive base, the electric charge generation layer and the electric charge transport layer are superposed (in this order) to form a laminate. It is also possible, however, to form a laminate by superposing in the order of: electrically conductive base, the electric charge transport layer and the electric charge generation layer.

The present invention relates to laminate type electrophotographic light-sensitive materials comprising at least one electric charge generation layer and at least one electric charge transport layer comprising at least one charge generating substance and at least one binder therefor. In the case of laminating the electric charge transport layer on the electric charge generation layer, the electric charge transporting substance is dissolved in an organic solvent composed of cyclic ethers such as tetrahydrofuran, etc., ketones such as methyl ethyl ketone, methyl isobutyl ketone, etc., or aromatic hydrocarbons such as benzene, toluene, xylene, etc., with a binder and the resultant solution applied to form a laminate. A solids content in the applying solution varies depending upon the applying method and kind of binder resin used, but generally is less than 30 wt%.

In the case of carrying out application as described above, the organic solvent dissolves the electric charge generating substance and the binder resin in the electric charge generation layer and, consequently, the electric charge generating substance is mixed in the electric charge transport layer to result in a remarkable deterioration in sensitivity.

Further, the electric charge generation layer is seriously degraded and loses coating film uniformity (the electric charge generating substance is not distributed uniformly), whereby coating film defects such as color spots occur.

Therefore, very important characteristics required for the binder resin for the electric charge generating substance include solvent resistance in the case of applying the electric charge transport layer in addition to dispersion stability for pigments, stability to dye solutions, storage stability, high sensitivity, cycle stability, pre-exposure effect resistance and good adhesion to the conductive base and the electric charge transport layer, etc. As a first method of improving solvent resistance, thermosetting resins such as urethane resins, melamine resins, etc., have been used; however, they generally have low sensitivity and cause desensitization when the electric charge generating substance is unstable to heat. Further, the coating film of the electric charge generation layer has the defects that it becomes brittle and cracks easily occur to cause defects of the coating film. Therefore, thermosetting resins are not preferred for use.

As a second method, water-soluble resins such as casein, polyvinyl alcohol, ethylene-acrylic acid copolymer, etc., have been used, but they have inferior dispersibility for electric charge generating substances, particularly pigments, and cause aggregation. Further, they have problems in that the sensitivity is low, and cyclic stability and storage stability, particularly moisture resistance, are poor. Therefore, the aqueous resins are also difficult to use.

A third method involves using binder resins for the electric charge generating substances which are thermoplastic and soluble in organic solvents so that the electric charge generation layer is not damaged by the solvent used for applying the electric charge transport layer. However, to date there have been discovered few resins which satisfy all requisites required for a binder resin for an electric charge generating substances.

SUMMARY OF THE INVENTION

As a result of earnest studies, the present inventors have found that polyvinylpyridine resins completely satisfy the above requisites required for a binder resin for an electric charge generating substance, including solvent resistance in the case of applying the electric charge transport layer.

Thus, the present invention relates to a laminate type electrophotographic light-sensitive element comprising at least one electric generation layer and at least one electric charge transport layer on an electrically conductive base, wherein the binder resin of the electric charge generating substance comprises one or more polyvinylpyridine resins.

Figure 1:
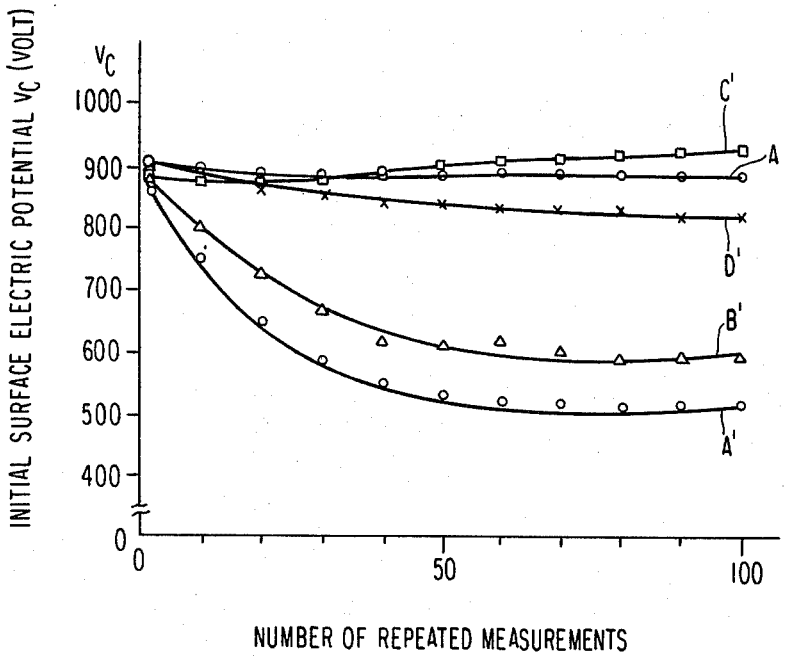
FIG. 1 and FIG. 2 illustrate the charging characteristics of laminate type electrophotographic light-sensitive materials shown in Example 1 and Comparative Examples 1, 2, 3 and 4.

The ordinate represents the initial surface electric potential (FIG. 1) or the residual electric potential (FIG. 2) and the abscissa represents the number of repeated measurements.

The symbol A represents Example 1 and the symbols A', B', C' and D' represent Comparative Examples 1, 2, 3 and 4, respectively.

DETAILED DESCRIPTION OF THE INVENTION

The present invention includes the embodiments of the base, charge generation layer and charge transport layer, and the base, charge transport layer and charge generation layer.

As polyvinylpyridine resins used in the present invention, there can be illustrated poly-2-vinylpyridine resin, poly-3-vinylpyridine resin and poly-4-vinylpyridine resin, all of which are soluble in alcohol solvents (e.g., methanol, ethanol, n-butanol, isopropanol, methyl cellosolve, ethyl cellosolve, etc.) but have resistance to organic solvents used for dissolving the electric charge transport substances and applying to form a laminate, such as cyclic ethers, aromatic hydrocarbons, ketones, esters, etc. Further, as polyvinylpyridine resins which can be used as a solution in alcohols in the case of laminating the electric charge transport layer and the electric charge generation layer on the electrically conductive base (in this order), there is the further advantage that an electric charge transport layer composed of materials which dissolve only in cyclic ethers, aromatic hydrocarbons, ketones or esters is not readily damaged.

The polyvinylpyridine resins may be used, if desired or necessary, in combination with other blend resins such as alcohol-soluble polyamide resins and polyvinyl acetate resins, in any proportion so long as the characteristics thereof are not harmed. However, in order to retain the excellent characteristics of the polyvinylpyridine resins, it is desirable to control the amount of the blend resins to up to 80 wt % per the total weight of resin. Suitable examples of the alcohol-soluble polyamide resins which can be used include N-methoxymethylated products of 6-nylon (e.g., Toresin F14C, EXP-58, EXP-107, EXP-101, F30-X, F30-C, F30, EF30T and MF30, produced by Teikoku Kagaku Sangyo Co.); polyamide resins obtainable from reaction of dimeric acids and di- or polyamines (e.g., Versamid 711 and 725, produced by Henkel Co.); Amilan CM-4000 and CM-8000, produced by Tray, Ltd.; Ultramid IC, produced by BASF AG; Luckamide 5003, produced by Dai-Nippon Ink Chemical Co., Ltd.; and the like. Suitable examples of the polyvinyl acetate resins which can be used include polyvinyl acetate and modified polyvinyl alcohol (e.g., Coponyl PK 40, produced by Japan Synthetic Chemical Co., Ltd.).

The electrically conductive base which can be used in the present invention is one having a surface resistance lower than that of the photoconductive material, preferably lower than $10^8\ \Omega$, and more preferably lower than $10^5\ \Omega$. Suitable examples of the electrically conductive base include drums and sheets of metals such as aluminum, copper, etc., laminates of metal foils of these metals, vacuum evaporation products with aluminum, copper, etc., and plastic films (e.g., a Mylar film) or paper having an electrically conductive surface which is prepared by applying a conductive substance such as a metal powder, carbon black, copper iodide, a high molecular weight electrolyte (e.g., one having a quaternary ammonium salt structure, a metal salt of polystyrene sulfonic acid, etc.), etc., together with a suitable binder resin (e.g., a cellulose resin, a polyvinyl alcohol resin, etc.). If desired or necessary, the electrically conductive base may have thereon a subbing layer such as a casein, carboxymethyl cellulose or polyvinyl alcohol layer.

As the electric charge generating substance and the electric charge transport substance used in the present invention, any of the earlier-described inorganic and organic materials can be used; the present invention is not limited to the use of these substances, however. In other words, as the electric charge generating substance used for the electric charge generation layer, any material which can absorb the light to generate an electric charge carrier with a quite high efficiency can be used.

A suitable particle size of the electric charge generating substance is less than 1μ, preferably less than 0.1μ.

An amount of binder resin with respect to the amount of the electric charge generating substance in the present invention can be optionally selected. However, taking into account the sensitivity of light-sensitive material, the binding to the electric charge generating substance, the adhesion to the electrically conductive layer or subbing layer and the like, the amount of binder resin is preferably in the range of 10 to 60 parts by weight, more preferably about 30 parts by weight, per 100 parts by weight of the electric charge generating substance. Further, the thickness of the electric charge generation layer is preferably 3μ or less, particularly 1μ or less. The thickness of the electric charge transport layer is preferably 5 to 30μ, particularly 8 to 15μ.

The number average molecular weight of the polyvinylpyridine resin used in this present invention is 2,000 to 500,000, preferably 8,000 to 150,000.

The alcohol solvent used together with the resin is methanol, ethanol, propanol, butanol, methyl cellosolve, ethyl cellosolve, etc., which solvents may be used alone or as a mixture thereof.

In the above, the laminate type electrophotographic light-sensitive material using polyvinylpyridine resin as a binder resin for the electric charge generating substance in the present invention has been explained. In the following, the present invention is illustrated in greater detail with reference to examples.

EXAMPLE 1

30 g of Diane Blue (C.I. No. 21180) and 12 g of poly-4-vinylpyridine resin (number average molecular weight: 40,000) dissolved in 1,000 g of methanol were put in a china ball mill. After dispersion for 40 hours, the mixture was applied to an aluminum plate 100μ thick by a dipping process and dried at 100° C. for 3 minutes to provide an electric charge generation layer having about a 0.2μ thickness. 100 g of 1-pyridyl-(2)-3-p-diethylaminostyryl-5-p-diethylaminophenylpyrazoline and 100 g of polycarbonate (Teijin Panlight K-1300, a product of Teijin Kasei Co. for poly-4,4'-dioxydiphenyl-2,2-propanecarbonate having a number average molecular weight of 30,000) were dissolved in 1,000 g of tetrahydrofuran, and the solution applied to the above-described electric charge generation layer in the same manner as for the electric charge transport layer, and dried to provide an electric charge transport layer about 10μ thick. Thus, a laminate type electrophotographic light-sensitive material was produced. The dispersion of the electric charge generating substance was excellent and aggregation of the pigment was not observed. Further, since the electric charge generation layer was not damaged by the tetrahydrofuran used for the application of the electric charge transport layer, a laminate type electrophotographic light-sensitive material having excellent quality coating films was produced. The charging characteristics thereof are later described.

COMPARATIVE EXAMPLE 1

A laminate type electrophotographic light-sensitive material was produced by the same process as in Example 1, except that the poly-4-vinylpyridine resin and methanol used for formation of the electric charge generation layer in Example 1 were replaced by butyral resin (S-LEC BM-2 (degree of butyration: 68 mol%, residual acetyl group: 3 mol%, average degree of polymerization: 800), produced by Sekisui Kagaku Kogyo K.K.) and ethanol, respectively.

When the solution of the electric charge transport substance in tetrahydrofuran was applied to the electric charge generation layer, the butyral resin in the electric charge generation layer dissolved in the tetrahydrofuran, whereby the electric charge generation layer was seriously damaged and non-uniform distribution of the electric charge generating substance occurred to result in defects in the coating film, such as color spots.

COMPARATIVE EXAMPLE 2

A laminate type electrophotographic light-sensitive material was produced by the same process as in Example 1 except that the poly-4-vinylpyridine resin and methanol used for formation of the electric charge generation layer in Example 1 were replaced by a polyester resin (Polyester Adhesive 49,000, produced by Du Pont Co.) and tetrahydrofuran, respectively. When the electric charge transport layer was applied to the electric charge generation layer, the same defects as in Comparative Example 1 resulted.

COMPARATIVE EXAMPLE 3

A laminate type electrophotographic light-sensitive material was produced by the same process as in Example 1 except that the poly-4-vinylpyridine resin and methanol used for formation of the electric charge generation layer in Example 1 were replaced by casein and a dilute aqueous ammonia solution containing 1.2 g of 28% aqueous ammonia, respectively. When the dispersion of the electric charge generating substance was examined, aggregation of the charge generating substance was observed and dispersibility thereof was very inferior.

COMPARATIVE EXAMPLE 4

A laminate type electrophotographic light-sensitive material was produced by the same process as in Example 1 except that the poly-4-vinylpyridine resin and methanol used for formation of the electric charge generation layer in Example 1 were replaced by polyvinyl alcohol (Poval PVA-124, produced by Kuraray Co.) and water, respectively. Dispersibility of the electric charge generating substance was poor and aggregation was easily caused.

Charging Characteristics

The laminate type electrophotographic light-sensitive material of Example 1 and Comparative Examples 1 to 4 were subjected to charging measurements using a conventional testing apparatus for electrostatic copying paper (Model SP-428 produced by Kawaguchi Denki Co.) and the results obtained are given in Table 1. In Table 1, $V_0$ (volt) is the initial surface electric potential in the case of corona charging by applying a −6 KV electric charge, $V_{10}$ (volt) is the initial surface electric potential after the element is allowed to stand for 10 seconds in the dark after electrical charging, and E ½ (lux.second) and E 1/10 (lux.second) are the exposure amounts necessary to decay $V_{10}$ (volt) to ½ and 1/10 the starting value thereof upon exposure to white light (5 lux) from a tungsten lamp.

TABLE 1

| | $V_0$ (volt) | $V_{10}$ (volt) | E ½ (lux · second) | E 1/10 (lux · second) |
|---|---|---|---|---|
| Example 1 | 910 | 830 | 6.8 | 27.5 |

TABLE 1-continued

| | $V_0$ (volt) | $V_{10}$ (volt) | E ½ (lux · second) | E 1/10 (lux · second) |
|---|---|---|---|---|
| Comparative Example 1 | 880 | 770 | 9.1 | 35.3 |
| Comparative Example 2 | 890 | 790 | 9.2 | 36.0 |
| Comparative Example 3 | 870 | 810 | 15.1 | 62.2 |
| Comparative Example 4 | 900 | 830 | 12.0 | 54.0 |

In the laminate type electrophotographic light-sensitive material of Example 1, the initial surface electric potential $V_0$ is nearly the same as that of Comparative Examples 1 to 4, but E ½ and E 1/10 are low and sensitivity is superior.

Figure 2:
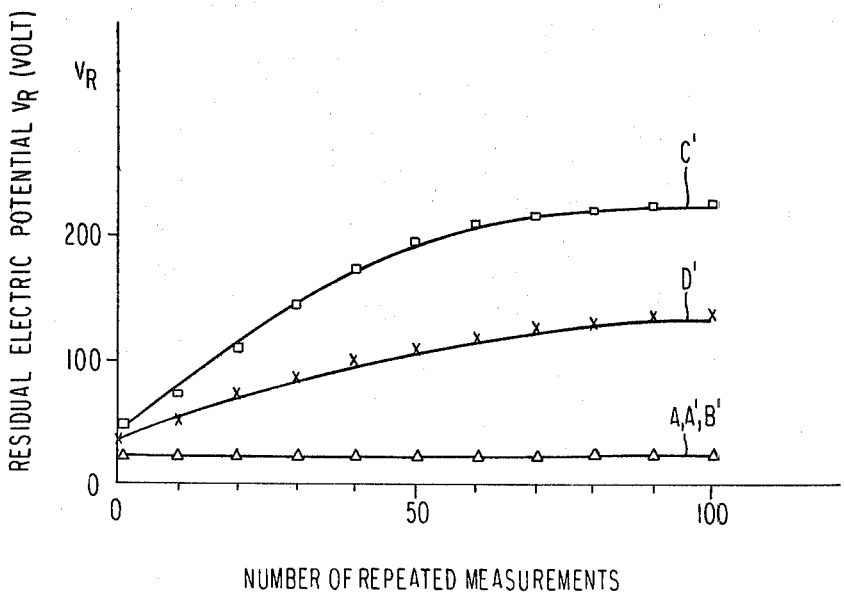

Appended FIGS. 1 and 2 show the variation of initial surface electric potential $V_C$ (volts) after corona charging and the variation of surface electric potential as residual electric potential $V_R$ (volts after exposure to white light (5 lux) for 1 second) when measurement is repeated 100 times wherein one measurement cycle comprises exposure to white light (50 lux) for 1 second from a tungsten lamp after the element has been allowed to stand for 4 seconds in the dark after corona charging at −6 KV.

Reference to FIGS. 1 and 2 shows that variations of the initial surface electric potential $V_C$ and the residual electric potential $V_R$ are very low in Example 1, which reflects stabilized cycle characteristics, but Comparative Examples 1 to 4 lack cycle stability in either one of $V_C$ and $V_R$ and cannot be practically used.

EXAMPLE 2

A laminate type electrophotographic light-sensitive material was produced by the same process as in Example 1 except that the Diane Blue and poly-4-vinyl-pyridine resin used for formation of the electric charge generation layer in Example 1 were replaced by β-copper phthalocyanine (Lionole Blue NCB toner, produced by Toyo Ink Mfg. Co.) and poly-2-vinylpyridine resin (number average molecular weight: 17,000), respectively, and the pyrazoline derivative and polycarbonate used for formation of the electric charge transport layer were replaced by 2,5-bis(p-diethylaminophenyl)-1,3,4-oxadiazole and polyester resin (Polyester Adhesive 49,000, produced by Du Pont Co.), respectively. In this case, the pigment dispersibility of the dispersion of the electric charge generating substance was excellent and the electric charge generation layer was not damaged by the organic solvent used for application of the electric charge transport layer. Thus, a light-sensitive material having excellent coating films could be produced.

When the charging characteristics of this light-sensitive material were measured in the same manner as in Example 1, $V_0$ was −850 volts, E ½ was 5.1 lux.seconds and cycle stability was excellent.

EXAMPLE 3

A laminate type electrophotographic light-sensitive material was produced by the same process as in Example 2 except that β-copper phthalocyanine used for formation of the electric charge generation layer in Example 2 was replaced by Diane Blue.

In this case, pigment dispersibility of the dispersion of the electric charge generating substance was excellent and the electric charge generation layer was not damaged by the solvent used for application of the electric charge transport layer. Thus, a light-sensitive material having excellent coating films was produced. When the charging characteristics of this light-sensitive material were measured in the same manner as in Example 1, $V_0$ was −880 volts, E ½ was 7.0 lux.seconds and cycle stability was excellent.

EXAMPLE 4

A laminate type electrophotographic light-sensitive material was produced by the same process as in Example 3 except that the poly-2-vinylpyridine resin used for formation of the electric charge generation layer in Example 3 was replaced by poly-4-vinylpyridine resin (number average molecular weight: 40,000).

The dispersion of the electric charge generating substance used in this example was the same as that in Example 1, and a light-sensitive material having excellent coating films was produced, as was the case for the light-sensitive material in Example 1.

When the charging characteristics of this light-sensitive material were measured in the same manner as in Example 1, $V_0$ was 920 volts, E ½ was 6.9 lux.seconds, and cycle stability was excellent.

EXAMPLE 5

A laminate type electrophotographic light-sensitive material was produced by the same process as in Example 4 except that the oxadiazole derivative used for formation of the electric charge transport layer in Example 4 was replaced by the pyrazoline derivative in Example 1. The dispersion of the electric charge generating substance used in this example was the same as that in Example 1, and a light-sensitive material having excellent coating films was produced, as was the case for the light-sensitive material in Example 1. When the charging characteristics of this light-sensitive material were examined, $V_0$ was −910 volts, E ½ was 7.3 lux.seconds, and cycle stability was excellent.

EXAMPLE 6

A laminate type electrophotographic light-sensitive material was produced in the same manner as in Example 5 except that the poly-4-vinylpyridine resin used for formation of the electric charge generation layer in Example 5 was replaced by 8 g of poly-3-vinyl-pyridine resin (number average molecular weight: 60,000) and 4 g of polyamide resin (Versamid 711, a product of Henkel Co. for polyamide resin obtainable by reaction of a dimeric acid and a di- or polyamine). In this case, the pigment dispersibility of the dispersion of the electric charge generating substance was excellent and the electric charge generation layer was not damaged by the organic solvent used for application of the electric charge transport layer. Thus, a light-sensitive material having excellent coating films was produced.

When the charging characteristics of this light-sensitive material were examined in the same manner as in Example 1, $V_0$ was −900 volts, E ½ was 7.4 lux.seconds and cycle stability was excellent.

EXAMPLE 7

To an aluminum surface of a polyester film vacuum evaporated with aluminum, a solution prepared by dissolving 12 g of poly-2-vinylpyridine resin (number average molecular weight: 17,000) and 30 g of Rose Bengale in 1,000 g of ethanol was applied by a dipping process to provide about a 0.2μ dry film thickness and the layer dried. Onto this electric charge generation layer, an electric charge transport layer was provided in the same manner as in Example 1 to yield a laminate type electrophotographic light-sensitive material. In this case, the solution of the electric charge generating substance had good liquid stability, and the electric charge generation layer was not damaged by the organic solvent used for application of the electric charge transport layer. Thus, a light-sensitive material having excellent coating films was produced.

When the charging characteristics of this light-sensitive material were examined, $V_0$ was −900 volts and E ½ was 150 lux.seconds.

While the invention has been described in detail and with reference to specific embodiments thereof, it will be apparent to one skilled in the art that various changes and modifications can be made therein without departing from the spirit and scope thereof.

What is claimed is:

1. In an electrophotographic light-sensitive material comprising at least one electric charge generation layer comprising a charge generating substance and a binder resin therefor and at least one electric charge transport layer on an electrically conductive base, said electrophotographic light-sensitive material is a laminate type electrophotographic light-sensitive material wherein the binder resin for the electric charge generating substance contains at least one polyvinylpyridine resin.

2. The material of claim 1, wherein said polyvinylpyridine resin is poly-2-vinylpyridine resin, poly-3-vinylpyridine resin or poly-4-vinylpyridine resin.

3. The material of claim 1, wherein said polyvinylpyridine resin has a number average molecular weight of 2,000 to 500,000.

4. The material of claim 1, wherein the amount of said binder resin containing at least one polyvinylpyridine resin is in the range of 10 to 60 parts by weight per 100 parts by weight of said electric charge generating substance.

5. The material of claim 1, wherein said binder resin further contains a blend resin selected from alcohol-soluble polyamide resin, polyvinyl acetate resin and modified polyvinyl acetate resin.

6. The material of claim 5, wherein the amount of said blend resin is up to 80% by weight based on the total weight of said polyvinylpyridine resin and blend resin.

* * * * *